United States Patent [19]

Leussler

[11] Patent Number: 4,680,036

[45] Date of Patent: Jul. 14, 1987

[54] METHOD OF AUTOMATICALLY CONTROLLING AN ELECTROSTATIC PRECIPITATOR

[75] Inventor: Wilhelm Leussler, Frankfurt am Main, Fed. Rep. of Germany

[73] Assignee: Metallgesellschaft Aktiengesellschaft, Frankfurt am Main, Fed. Rep. of Germany

[21] Appl. No.: 884,368

[22] Filed: Jul. 11, 1986

[30] Foreign Application Priority Data

Jul. 26, 1985 [DE] Fed. Rep. of Germany ..... 3526754

[51] Int. Cl.[4] ..... B03C 3/68

[52] U.S. Cl. ..... 55/2; 55/105

[58] Field of Search ..... 55/2, 105, 139

[56] References Cited

U.S. PATENT DOCUMENTS 3,893,828 7/1975 Archer ..... 55/105 X
4,138,232 2/1979 Winkler et al. ..... 55/105
4,284,417 8/1981 Reese et al. ..... 55/2
4,354,860 10/1982 Herklotz et al. ..... 55/105
4,445,911 5/1984 Lind ..... 55/2
4,486,704 12/1984 Gustafsson et al. ..... 55/105 X

*Primary Examiner*—Kathleen J. Prunner
*Attorney, Agent, or Firm*—Felfe & Lynch

[57] ABSTRACT

Disclosed is a method for the operation of an electrostatic precipitator so as to provide a pure gas having a predetermined dust content with a minimum consumption of energy. Characteristics for the operation with an unpulsed voltage are recorded for different dust resistivities. Each characteristic has then associated with it that k value with which a pure gas having a predetermined dust can be achieved with a minimum energy consumption. During operation, the actual characteristic is compared with the recorded characteristics and that k value is selected which is associated with the recorded characteristic which coincides with the actual characteristic or is next below the actual characteristic. The actual characteristic is determined in predetermined intervals, the duration of which is determined in dependence on the speed with which the operating conditions may be expected to change.

6 Claims, 5 Drawing Figures

METHOD OF AUTOMATICALLY CONTROLLING AN ELECTROSTATIC PRECIPITATOR

BACKGROUND OF THE INVENTION

The present invention relates to a method of operating an electrostatic precipitator to obtain a pure gas having a predetermined dust content with a minimum energy consumption, wherein the voltage applied to the precipitator is automatically controlled by semipulses.

Published German Application No. 31 14 009* discloses an electrostatic precipitator in which dust is collected under the action of a high d.c. voltage, which is applied between the collecting electrodes and the corona electrodes, and is adapted to be controlled by a thyristor. The precipitator is provided with a control circuit for an intermittent activation of the thyristor in such a manner that the repetition period and/or the pulse width of the high d.c. voltage can be manually or automatically adjusted. The control circuit is intended to improve the collection efficiency of the electrostatic precipitator particularly, in case of high dust resistivities in the range from $10^{11}$ to $10^{13}$ ohm-cm, in which the operation of an electrostatic precipitator is normally unsatisfactory due to the occurrence of reverse corona discharges.

*corresponds to U.S. Pat. 4 410 849

In the known control circuit the thyristor is activated in such a manner that the high d.c. voltage is applied during a first interval of time $T_1$ mounting, e.g., to 0.001 to 1 second, and is interrupted for a second interval of time $T_2$ amounting, e.g., to 0.01 to 1 second. The ratio of $T_1$ to $(T_1+T_2)$, i.e., the ratio of the pulsing time to the pulsing and non-pulsing times, in each switching cycle may be described as the k value and the entire method can be described as "control by semipulses".

A special object of the known method is to avoid reverse corona discharges, which are represented in the current-voltage characteristic by a comparatively very steep rise of the current in conjunction with an only slight voltage rise. This results in a high energy consumption but a low dust collection efficiency in the electrostatic precipitator. However, there is a certain delay between the occurrence of reverse corona discharges and the increase of voltage and/or current effected by the conventional automatic control so that the reverse corona discharges can be substantially avoided and an economical operation of the electrostatic precipitator can be achieved by the use of the semipulses.

It is apparent that the measures proposed in Published German Application No. 31 14 009 are adopted in order to achieve an optimum collection efficiency even when the dust has a high resistivity.

However, the practice of the above-described method does not take into account that operation with an optimum collection efficiency may result in pure gases having quite different dust contents in dependence on the dust resistivity and that these dust contents may be higher or lower than a prescribed value. In other words, the known control is not directed to the actual object of dust collection, namely, to reduce the original dust content from its original value to a value which complies with local emission standards. Whereas it may be desirable from an ecologic aspect to provide a pure gas having a dust content which is much lower than the prescribed limit, that practice will introduce avoidable costs into the production and will tend to reduce competitiveness. A control by means of a system which does not take the dust content of the pure gas into account may achieve an optimum from a technical aspect but may not be economically desirable.

SUMMARY OF THE INVENTION

It is an object of the present invention to provide improved control in operating an electrostatic precipitator and in particular to improve automatically controlling an electrostatic precipitator, such that under changing operating conditions, high collection efficiency will be achieved and a pure gas having the prescribed dust content will be obtained with minimum energy consumption. This and other objects of the invention are obtained by (a) recording typical current-voltage characteristics (I=f (V,ohm) for an operation with an unpulsed voltage (k=1) and different dust resistivities for a given electrostatic precipitator, (b) determining for each characteristic the lowest k value with which a pure gas having the predetermined dust content is obtained, (c) associating the determined lowest k value with each characteristic, and continuously automatically controlling the electrostatic precipitator in consideration of said characteristics in such a manner that (d) the actual characteristic for the operation with an unpulsed voltage is compared with the recorded characteristics and that k value is selected which corresponds to the recorded characteristic which coincides with the actual characteristic or is next below the actual characteristic.

In a further development of the invention the characteristics are recorded when the electrostatic precipitator is put into operatior or in dependence on empirical values. Additionally, the recorded characteristics are continually corrected in dependence on actual characteristics ascertained during operation. The adjustment of the k value in accordance with step (d) supra is repeated in predetermined intervals of time. Finally, the sequence of all steps of the method in accordance with the invention is fully automatically controlled.

The various features of novelty which characterize the invention are pointed out with particularity in the claims annexed to and forming a part of this specification. For a better understanding of the invention, its operating advantages and specific objects obtained by its use, reference should be had to the accompanying drawings and descriptive matter in which there is illustrated and described a preferred embodiment of the invention.

DESCRIPTION OF PREFERRED EMBODIMENT

Figure 1:
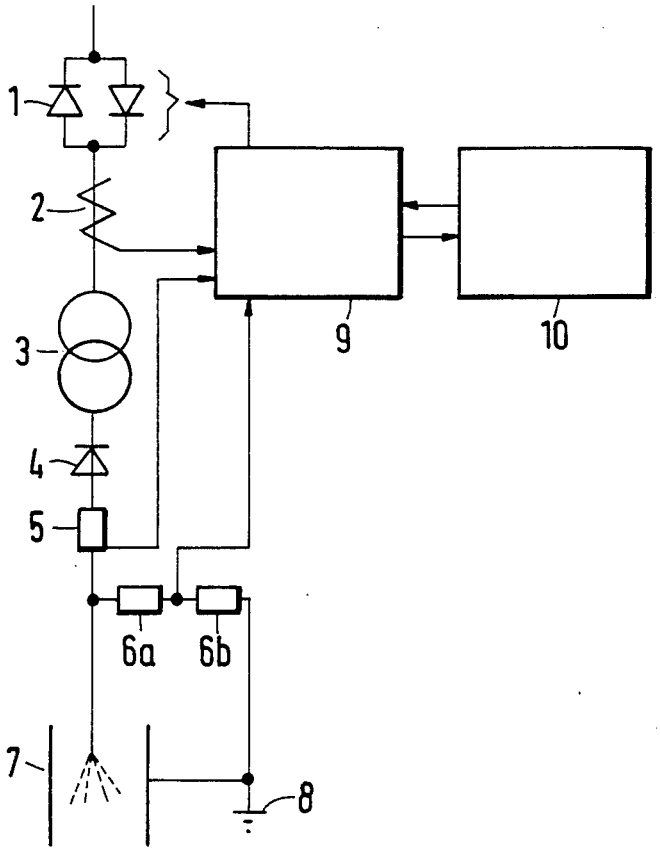
FIG. 1 is a simplified circuit diagram of the voltage supply circuit of an electrostatic precipitator controlled by semipulses.

Referring to FIG. 1, the electrostatic precipitator is powered via two thyristors 1, which are connected back-to-back, a high voltage transformer 3 and a rectifier 4. The collecting electrodes as well as the precipitator housing 7 are grounded at 8. The corona electrodes are connected to the negative pole of the high voltage source. The primary current in the high voltage transformer 3 is measured by means of a current transformer 2. The secondary or precipitator current is measured via a shunt 5. The secondary or precipitator voltage is measured by means of a measuring bridge *6a, 6b*. The output signals of 2, 5, 6*a* and 6*b* represent measured values and are delivered to an electronic controller 9, which generates the pulses for firing the thyristors 1. The controller 9 is fully automatic in operation; it monitors the current and prevents it from rising above the rated current. The controller monitors also the voltage and ensures that the voltage applied will always be as close as possible to the flashover voltage and that the voltage will be decreased in response to a flashover and the plant will be de-energized in case of a permanent short circuit.

A microcomputer 10 is also provided, in which the digitalized characteristics of the precipitator as well as the associated k values are stored. In predetermined intervals of time the controller 9 is used to ascertain the actual current-voltage characteristic of the precipitator, said actual characteristic is compared with the recorded characteristics and a new k value is delivered to the controller if the comparison of characteristics has indicated that a more favorable k value can be adopted.

In accordance with the invention those k values are associated with the characteristics ascertained under different operating conditions which ensure that a pure gas having a predetermined dust content will be obtained with a minimum consumption of energy. Because the measuring and computing operations are performed very quickly, the collection efficiency will not decrease during the recording of a new characteristic. As modern electrostatic precipitators usually include a plurality of precipitator units connected in series and said units are checked and operated in succession as described, a pure gas having a predetermined dust content will be obtained with minimum energy consumption even if the operating conditions change quickly.

It is also possible to compare only selected sections of the characteristics so that the time required to record the characteristics will be shortened and a faster response to changes in the operating conditions of the precipitator will be possible. The repetition intervals may be adjusted between a few minutes and hours. This will depend on whether the operating conditions change quickly, as will be the case when dust is to be collected from the exhaust gases from steelmaking converters, or whether the changes are only small and slow, as will be the case when dust is to be collected from the flue gases from power plant furnaces.

Figure 2:
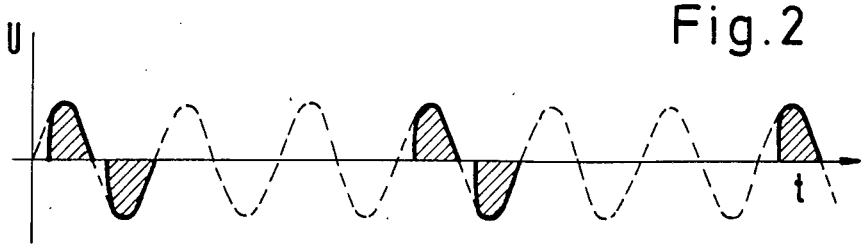
FIG. 2 shows the time changes of the primary voltage for a k value of $\frac{1}{3}$.

In FIG. 2, the primary voltage of the high-voltage transformer 3 is represented by a dotted line for the value $k=1$ (unpulsed operation) and by a dotted line for $k=\frac{1}{3}$; in the latter case only every third of three complete sine waves is conducted by the thyristor.

Figure 3:
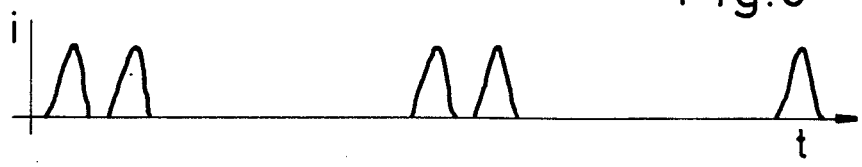
FIG. 3 shows the time changes of the precipitator current for a k value of $\frac{1}{3}$.

In FIG. 3 the secondary current of the rectifier 4 or the precipitator current obtained during a pulsed operation as shown in FIG. 1 is represented. Two consecutive pulses are always succeeded by a currentless interval having twice the duration of the pulsing time.

Figure 4:
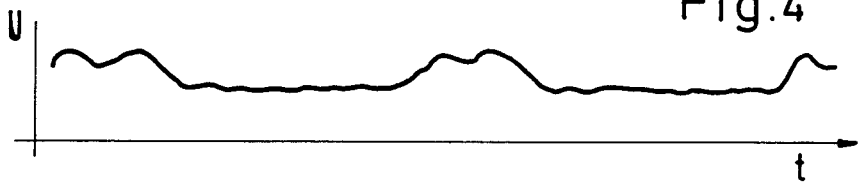
FIG. 4 shows the voltage applied to the electrostatic precipitator for a k value of $\frac{1}{3}$.

FIG. 4 represents the voltage applied to the electrostatic precipitator. Because the precipitator acts as a capacitor, the voltage does not return to zero after each pulsing time but returns only to a certain residual voltage and increases to the maximum when the pulsing is resumed.

Figure 5:
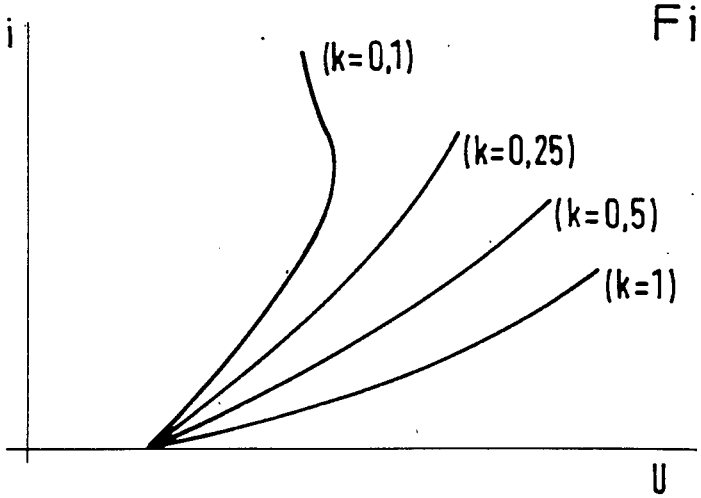
FIG. 5 shows four current-voltage characteristics having four different k values associated with them.

FIG. 5 shows the recorded characteristics of a precipitator, i.e., a graph in which the current consumption is plotted against the applied voltage for various operating conditions. The latter are determined by the gas temperature, the gas composition, the dust resistivity and a number of other controlling variables. In accordance with the invention the k values associated with the various characteristics are those which must be used to provide a pure gas having the predetermined dust content with a minimum consumption of energy.

The characteristic designated $k=1$ is typical for low dust resistivities up to about $10^{11}$ ohm-cm. The characteristic designated $k=0.1$ is typical for very high dust resistivities in excess of $10^{13}$ ohm-cm. The two other characteristics are applicable to intermediate dust resistivities.

The following facts can be derived from the association of the k values with the charactersitics: When the dust resistivity is low, a pure gas having the predetermined dust content is preferably obtained by an unpulsed operation. It case of a very high dust resistivity the same object will be accomplished if the non-pulsing time is, e.g., nine times the pulsing time $T_1$, i.e., if the pulsing time is only one-tenth of the total time. Particularly interesting are the characteristics between the k values 1 and 0.1 because the dust resistivity is between $10^{11}$ and $10^{13}$ ohm-cm in many cases and a repeated close adaptation to the actual conditions is particularly important and beneficial in such cases.

The method in accordance with the invention permits a pure gas having a predetermined dust content to be obtained with a minimum consumption of energy under all operating conditions. Emission limits cannot be determined simply in order to minimize pollution but must also take into account the technical feasibility and the costs involved. For instance, if the pure gas leaving a power plant has such a low dust content that the expenditure involved would not permit the production of power which can be sold at a profit, such plant would no longer be operated or would not be erected. But if power is to be produced, a realistic dust content of the pure gas must be prescribed. In accordance with the present invention the dust content of the pure gas is not as low as possible regardless of the energy consumption but it is desired and possible to obtain a pure gas having a predetermined dust content with a minimum energy consumption so that a pure gas having a relatively low dust content can be obtained in an operation which is realistic from technical and economical considerations.

It will be understood that the specification and examples are illustrative but not limitative of the present invention and that other embodiments within the spirit and scope of the invention will suggest themselves to those skilled in the art.

I claim:

1. A method of operating an electrostatic precipitator to obtain a pure gas having a predetermined dust content with a minimum energy consumption, wherein the voltage applied is automatically controlled by semi-pulses, comprising:

(a) recording for a given electrostatic precipitator typical current-voltage characteristics (I =f (V,ohm) for an operation with an unpulsed voltage (k =1) and different dust resistivities;

(b) determining for each characteristic the lowest k value with which a pure gas having the predetermined dust content is obtained;

(c) associating the thus determined lowest k value with each characteristic, and continuously automatically controlling the electrostatic: precipitator in consideration of said characteristic in such a manner that (d) the actual characteristic for the operation with an unpulsed voltage is compared with the recorded characteristics and that k value is selected which corresponds to the recorded characteristic which coincides with the actual characteristic or is next below the actual characteristic.

2. The method of claim 1 wherein the characteristics are recorded when the electrostatic precipitator is put into operation.

3. The method of claim 1 wherein the characteristics are recorded in dependence on empirical values.

4. The method of claim 1 wherein recorded characteristics are continually corrected in dependence on actual characteristics ascertained during operation.

5. The method of claim 1 wherein the adjustment of the k value in accordance with measure (d) is repeated at predetermined intervals of time.

6. The method of claim 1 wherein the sequence of all steps is fully automatically controlled.

* * * * *